US005147603A

United States Patent [19]

Nussbaum et al.

[11] Patent Number: 5,147,603

[45] Date of Patent: Sep. 15, 1992

[54] RAPIDLY SOLIDIFIED AND WORKED HIGH STRENGTH MAGNESIUM ALLOY CONTAINING STRONTIUM

[75] Inventors: Gilles Nussbaum, Passy; Damien Deweirder, Saint Leu La Forêt, both of France; Haavard T. Gjestland, Porsgrunn, Norway

[73] Assignees: Pechiney Electrometallurgie, Courbevoie, France; Norsk Hydro A.S., Oslo, Norway

[21] Appl. No.: 704,620

[22] Filed: May 23, 1991

[30] Foreign Application Priority Data

Jun. 1, 1990 [FR] France ..... 9007299

[51] Int. Cl.[5] ..... C22C 1/00

[52] U.S. Cl. ..... 420/409; 148/420; 420/407; 420/408

[58] Field of Search ..... 148/420; 420/407–409

[56] References Cited

U.S. PATENT DOCUMENTS 3,182,390 5/1965 Foerster ..... 420/409
4,765,954 8/1988 Das et al. ..... 148/420
4,770,850 9/1988 Hehmann et al. ..... 420/402
4,990,198 2/1991 Masumoto et al. ..... 148/403

FOREIGN PATENT DOCUMENTS 2201460 7/1973 Fed. Rep. of Germany ..... 420/407

OTHER PUBLICATIONS

Froes et al Jour. of Metas. Aug. 1987, pp. 14–21.

*Primary Examiner*—Upendra Roy
*Attorney, Agent, or Firm*—Dennison, Meserole, Pollack & Scheiner

[57] ABSTRACT

An alloy based on magnesium with a load at rupture of at least 290 MPa and an elongation at rupture of at least 5%, the alloy comprising by weight, 2 to 11% aluminum, 0 to 1% manganese, 0.1 to 6% strontium, various possible impurities, and the remainder magnesium. The alloy has a structure including a matrix of fine grains of magnesium of a mean size below 3 μm reinforced by intermetallic compounds dispersed homogeneously at the grain boundairies and having a mean size less than 1 μm, the structure remaining unchanged if kept for more than 24 hours at a temperature up to 300° C.

17 Claims, No Drawings

RAPIDLY SOLIDIFIED AND WORKED HIGH STRENGTH MAGNESIUM ALLOY CONTAINING STRONTIUM

TECHNICAL FIELD

The invention concerns magnesium alloys of high mechanical strength containing strontium and a method of preparing them. It particularly concerns commercial magnesium alloys listed under the names AZ 31, AZ 61, AZ 80 (welding alloys) and AZ 91, AZ 92 (moulding alloys) in accordance with the ASTM standard (or respectively G-A3Z1, G-A6Z1, G-A8Z, G-A9Z1, G-A9Z2 in accordance with French standard NFA 02-004) with strontium added to them. The alloys may contain manganese and/or calcium as alloying additions.

STATE OF THE ART

In Application EP 89-903 172 Applicants have already proposed magnesium alloys obtained by rapid solidification, which have improved mechanical properties; these alloys may contain calcium. In Application FR 89-11357 they have also proposed magnesium alloys with improved mechanical properties containing Ca and rare earths, which are additionally found to have improved corrosion resistance.

In view of these good results, however, they have tried to get away from the need to use elements such as rare earths, which are expensive products and have to be used cautiously. In particular, rare earths have to be refined so that they only contain very little Fe, Ni or Cu, and this significantly increases their cost. They are also tricky to add to the liquid magnesium bath owing to their great reactivity with oxygen. Furthermore it is difficult to obtain a really homogeneous bath when they are added, owing to their high density.

Applicants have therefore sought to avoid using these elements and to obtain mechanical properties which are at least equivalent if not improved (breaking strength and particularly ductility) together with improved resistance to corrosion.

DESCRIPTION OF INVENTION

The invention is an alloy based on magnesium with a load at rupture of at least 290 MPa and an elongation at rupture of at least 5%, characterised in that it is of the following composition (by weight):

Aluminium 2–11%;

Manganese 0–1% and preferably 0.1–0.7%;

Strontium 0.1–6% and preferably 1–5%;

with the following content of the main impurities (by weight):

Silicon $<0.6\%$

Copper $<0.2\%$

Iron $<0.1\%$ the remainder being aluminium.

The alloy may also contain at least one of the elements Zn and/or Ca as an addition, in the following proportions:

Zn 0–12% and preferably 0–3%

Ca 0–7%

The normal microstructure of the alloys obtained may be characterised as follows: the matrix is made up of fine grains of magnesium of an average dimension smaller than 3 μm or more advantageously no larger than approximately 1 μm; it is reinforced by precipitates of intermetallic compounds dispersed homogeneously, preferably at the grain boundaries, and varying in size and nature according to the chemical composition of the alloy.

Thus $Al_4Sr$, $Mg_2Sr$, $Mg_{17}Sr_2$ and/or $Mg_{17}Al_{12}$ are generally found, according to the respective content of Al and Sr; these dispersoids are preferably in the grains for sizes smaller than 0.1 μm and at the grain boundaries for larger sizes, from 0.1 to 1 μm this is the case of $Mg_{17}Al_{12}$ compounds. Sr may equally be in solid solution in Mg and $Mg_{17}Al_{12}$. When Ca is present in a large enough quantity in the alloy it is found in solid solution in $Mg_{17}Al_{12}$ and in the form of fine metastable globules rich in Al and Ca and smaller than 0.1 μm The globules are dispersed in the Mg matrix and can be converted to $Al_2Ca$ by heat treatment.

This structure remains unchanged after being kept at 250° C. for 24 hours.

The alloy according to the invention is normally obtained by rapid solidification processes and the various methods of applying them described in Application EP 89-903172, which are an integral part of the description. To summarise, the alloy in the liquid state is subjected to rapid solidification at a speed of at least $10^4$ K. $sec^{-1}$, generally less than $10^7$ K. $sec^{-1}$, so as to obtain a solidified product with at least one dimension smaller than 150 μm that product is then consolidated directly by precompacting and compacting or by direct compacting, compacting taking place at a temperature from 200° to 350° C. It is preferable for the solidified product not to undergo any other processing operating such as grinding before being consolidated by precompacting and/or direct compacting, since that operation might adversely affect the mechanical properties of the consolidated alloy obtained.

Rapid cooling for solidification may be obtained:

either by casting in band form on an apparatus known as a machine "for overhardening on a cylinder" (by methods known as free jet melt spinning or plan ar flow casting), the apparatus normally comprising an intensively cooled drum on which the metal is cast in the form of a band of a thickness less than 150 μm and preferably of the order of 30 to 50 μm;

or by fusing an electrode or by a jet of liquid metal; the liquid metal is then mechanically divided or atomised and projected onto a surface which is intensively cooled and kept clear, or by atomising the liquid alloy in a jet of inert gas.

The first two methods give a solid in the form of bands, scales or tip, while the last gives a powder. The processes are described in detail in Application EP 89-903 172. The rapidly solidified product may be degassed under vacuum at a temperature no higher than 350° C. before being consolidated.

Consolidation is also described in that application; in accordance with the invention it is carried out directly on the rapidly solidified products, and particularly directly on the scales or tip. In order to preserve the fine, unique structure obtained after rapid solidification it is important to avoid long exposure to high temperature. It was therefore decided to carry out tepid extrusion, which minimises the duration of high temperature passage through the machine.

The extrusion temperature is from 200° to 350° C.; the extrusion ratio is generally from 10 to 40 and preferably 10 to 20, and simulataneously the speed at which the ram advances is preferably from 0.5 to 3 mm/sec, although it may be higher (for example 5 mm/sec). As described in said application, the solid may be treated as follows prior to consolidation:

- either placed directly in the container of a press then extruded,
- or precompacted cold or at a tepid temperature (e.g. below 350° C.), using a press, for example in the form of a billet of a density close to 99% of the theoretical density of the alloy, the billet subsequently being extruded,
- or precompacted cold to 70% of the theoretical density and placed in a sheath of magnesium, magnesium alloy, aluminium or aluminium alloy, which is itself placed in the container of the extruding press; the sheath can then be machined off after the extruding step.

The sheath may have a thin wall (less than 1 mm) or a thick one (up to 4 mm). It is preferable in all cases for the alloy forming the sheath to have a flow limit not in excess of that of the product to be extruded, at the extruding temperature.

In an alternative embodiment other compacting methods may be used which do not raise the temperature of the product above 350° C.: these optional processes include hydrostatic extrusion, forging, rolling and superplastic forming and hot isostatic compression (HIP).

Thus the method of the invention unexpectedly makes it possible to obtain a consolidated magnesium alloy which, as already described, has a structure of fine grains (grains smaller than 3 μm) stabilised by intermetallic compounds and/or by metastable dispersoids, and good mechanical properties. The structure and mechanical properties of the alloy remain unchanged after the alloy has been kept for a long period, of 24 hours and over, at a temperature of up to 250° C., or even 300° C. in certain cases, e.g. when the alloy contains calcium.

This fine structure is observed by using optical electron microscopy, X-ray diffraction and transmission electron microscopy. The matrix essentially comprises aluminium containing approximately 1 (atomic) % of Al in solid solution; the grain size is very small, usually from 0.3 to 1 μm; it depends on the consolidating conditions.

The intermetallic phases observed depend on the composition of the alloy; they may be $Mg_{17}Al_{12}$, possibly containing Sr and/or Zn, $Mg_{32}(Al,Zn)_{49}$, $Mg_{17}Sr_2$, $Mg_2Sr$, $Al_4Sr$ and, when the alloy contains calcium, $Al_2Ca$. Rapid cooling enables metastable phases to form.

The dimension of the intermetallic compounds is smaller than 1 μm, and their particle size distribution is generally bimodal:

- a first mode generally being from 0.1 to 1 μm with the corresponding particles at the grain boundaries; this is often the case of $Mg_{17}Al_{12}$,
- a second mode being smaller than 0.1 μm and made up of globules dispersed homogeneously throughout the alloy (in the grains and also at the grain boundaries); this is the case e.g. of $Al_4Sr$, $Mg_{17}Sr$, $Al_2Ca$ and the like.

All these phases help to harden the alloys. Those with the highest melting point (e.g. $Al_4Sr$) guarantee the thermal stability of properties of the alloy obtained.

The load at rupture obtained with alloys according to the invention is high; it generally exceeds 400 MPa and is at least at the same level as that obtained e.g. with the alloys described in the above-mentioned applications; an improvement in ductility and hardness are also noted.

Strontium significantly improves breaking strength with some magnesium alloys, particularly those containing calcium or commercial alloys of the AZ91 type, though sometimes at the expense of ductility.

Resistance to corrosion is also very good, for the absence of pitting is noted as well as the very small loss of weight in a salt water medium; the alloys according to the invention keep a very shiny appearance; only a few shallow, localised patches of corrosion are observed, looking like foliage.

EXAMPLES

Several alloys are produced by rapid solidification under conditions identical with those used in the examples in above-mentioned Application EP 89-903 172: casting on a wheel, peripheral speed of wheel 10 to 40 m/sec, speed of cooling from $10^5$ to $10^6$ K. $s^{-1}$. The bands obtained are then placed directly into the container of an extruding press, to obtain a consolidated alloy on which the characterising tests are carried out: microscopic examination and measurement of mechanical properties and resistance to corrosion.

Mechanical properties

Table 1 gives the operating conditions for extrusion and the characteristics of the alloys obtained:

Hv = Vickers hardness expressed in kg/mm²
TYS = elastic limit measured at 0.2% residual elongation, expressed in MPa
UTS = load at rupture expressed in MPa
e = elongation at rupture expressed as %.

TABLE 1

| | INVENTION | | | | | | PRIOR ART | | | |
|---|---|---|---|---|---|---|---|---|---|---|
| Test no. | 30 | 31 | 32 | 33 | 34 | 35 | 23 | 12 | 9 | 20 |
| Composition of alloy % by wt.(1) | | | | | AZ 91 + Sr | AZ 91 + Sr | AZ 91 | AZ 91 + Ca | | |
| Al | 9 | 7 | 5 | 9 | 9 | 9 | 9 | 9 | 5 | 5 |
| Zn | 0 | 0 | 0 | 0 | 0,6 | 0,6 | 0,6 | 0,6 | 0 | 0 |
| Mn | 0 | 0 | 0 | 0 | 0,2 | 0,2 | 0,2 | 0,2 | 0 | 0 |
| Ca | 0 | 0 | 0 | 6,5 | 0 | 0 | 0 | 2 | 3,7 | 6,5 |
| Sr | 1 | 3 | 5 | 3 | 1 | 2 | 0 | 0 | 0 | (Nd = 2) |
| T° extrusion °C. | 300 | 300 | 300 | 300 | 300 | 300 | 300 | 300 | 250 | 300 |
| Extrusion ratio | 20 | 20 | 20 | 20 | 20 | 20 | 20 | 20 | 20 | 20 |
| Ram speed mm/sec | 0,5 | 0,5 | 0,5 | 0,5 | 0,5 | 0,5 | 0,5 | 0,5 | 0,5 | 0,5 |
| Hv kg/mm² | 109 | 106 | 105 | 137 | 113 | 117 | 105 | 125 | 124 | 132 |
| TYS (0,2) | 325 | 367 | 448 | 613 | 378 | 408 | 330 | 405 | 538 | 564 |

TABLE 1-continued

| | INVENTION | | | | | | PRIOR ART | | | |
|---|---|---|---|---|---|---|---|---|---|---|
| Test no. | 30 | 31 | 32 | 33 | 34 | 35 | 23 | 12 | 9 | 20 |
| MPa | | | | | | | | | | |
| UTS MPa | 423 | 420 | 473 | 628 | 451 | 467 | 380 | 466 | 567 | 592 |
| e % | 19 | 20 | 13 | 0,4 | 18 | 17 | 20 | 9,5 | 5,2 | 2 |

(1)The balance being Mg

It will be seen from the table that the alloys in tests, 30, 31 and 32, with Al and Sr as the alloying additions, have very good breaking strength combined with very high ductility.

In test 33 calcium is included as an extra alloying addition; this test also compares the replacement of a rare earth (Nd) in the prior art alloy of test 20 by Sr. A net gain in mechanical properties is observed, with breaking strength reaching the record value of 628 MPa and a comparable level of ductility being maintained.

Similarly, if Sr is added to an AZ 91 alloy (tests 34 to 35) and compared to an AZ 91 alloy alone (test 23), it will be seen that breaking strength is improved while ductility remains the same. If this is compared with an AZ 91 alloy containing Ca (test 12), it will be seen that ductility is considerably improved: with an equal content of Sr and Ca, the alloy with Sr is nearly 80% more ductile than the alloy with Ca.

Resistance to corrosion

The resistance of various alloys to corrosion is assessed by immersing them in a 0.05% aqueous solution of NaCl buffered with magnesia at pH=10.2. Table 2 gives the weight losses recorded, relative to the weight loss of the conventional alloy most resistant to corrosion, namely a prior art AZ 91 alloy (test 23) prepared under the same conditions.

TABLE 2

| Test No. | Alloy | Weight loss alloy / Weight loss AZ 91 |
|---|---|---|
| 23 (Prior art) | AZ 91 | 1 |
| 9 (Prior art) | Mg—5Al—3,7Ca | 5 |
| 30 | Mg—9Al—1Sr | 0.6 |
| 36 | Mg—10Al—5Sr | 0.8 |

It will be seen that the alloys containing Sr according to the invention (test 30-36) have very good resistance to corrosion in this medium, better than that of prior art alloys (tests 23-9).

What is claimed is:

1. An alloy based on Mg, with a load at rupture of at least 290 MPa and an elongation at rupture of at least 5%, comprising, by weight, the elements:

Aluminium 2–11%;
Manganese 0–1%;
Strontium 0.1–6%;

with the following content of the main impurities:

Silicon <0.6%
copper <0.2%
iron <0.1%
nickel <0.01%
the remainder being magnesium, said alloy having a structure including a matrix of fine grains of magnesium of a mean size below 3 μm reinforced by intermetallic compounds dispersed homogeneously at the grain boundaries and having a size less than 1 μm, said structure remaining unchanged if kept for more than 24 hours at a temperature up to 300° C.

2. The alloy of claim 1, comprising:

Aluminium 2–11%;
Manganese 0.1–0.7%;
Strontium 1–5%.

3. The alloy of claim 1, wherein the fine grains of magnesium have an average size smaller than about 1 μm.

4. The alloy of claim 1, wherein the intermetallic compounds are selected from the group consisting of $Al_4Sr$, $Mg_2Sr$, $Mg_{17}Sr_2$, $Mg_{17}Al_{12}$, and mixtures thereof.

5. The alloy of claim 1 or 2, additionally containing at least one of the elements Zn and/or Ca in the following proportions by weight:

Zn 0—12%
Ca 0—7%.

6. An alloy according to claim 1 or 2, obtained by subjecting the alloy elements in the liquid state, to rapid cooling at a speed of at least $10^4$ K. $sec^{-1}$, so as to obtain a solidified product with at least one dimension smaller than 150 μm, then directly compacting the cooled alloy elements at a temperature from 200° to 350° C.

7. The alloy of claim 6, wherein the rapid cooling is performed by casting on an intensively cooled mobile surface, in the form of a continuous band thinner than 150 μm.

8. The alloy of claim 6, wherein the rapid cooling is performed by spraying the liquid alloy elements onto an intensively cooled surface which is kept clear.

9. The alloy of claim 6, wherein the rapid cooling is performed by atomising liquid alloy elements by means of a jet of inert gas.

10. The alloy of claim 6, wherein the compacting is effected by a means selected from press extrusion, hydrostatic extrusion, rolling, forging and superplastic deformation.

11. The alloy of claim 10 wherein the compacting is effected by press extrusion at a temperature from 200° to 350° C., with an extrusion ratio of 10 to 40, the press having a ram advancing at a speed of 0.5 to 3 mm/sec.

12. An alloy based on Mg, with a load at rupture of at least 290 MPa and an elongation at rupture of at least 5%, comprising, by weight, the elements:

Aluminium 2–11%;
Manganese 0–1%;
Strontium 0.1–6%;

with the following content of the main impurities:

Silicon <0.6%
copper <0.2%
iron <0.1%
nickel <0.01%
the remainder being magnesium, obtained by subjecting the alloy elements in the liquid state, to rapid cooling at a rate of at least $10^4$° K. $sec^{-1}$, so as to obtain a solidified product with at least one dimension smaller than 150 μm, then directly compacting the cooled alloy elements by press extrusion at a temperature of 200° to 350° C., with an extrusion ratio of 10 to 40, the press having a ram advancing at a speed of 0.5 to 3 mm/sec.

13. The alloy of claim 12, wherein the rapidly solidified product is inserted directly in the container of the extruding press.

14. The alloy of claim 12, wherein the rapidly solidified product is placed in a metal sheath made of aluminium, magnesium or an alloy based on either of these two metals, before compacting.

15. The alloy of claim 12, wherein the rapidly solidified product is precompacted before compacting in the form of a billet at a temperature no higher than 350° C.

16. The alloy of claim 12, wherein the rapidly solidified product is degassed under vacuum at a temperature no higher than 350° C. before being compacted.

17. The alloy of claim 12, wherein the extrusion ratio is 10 to 20.

* * * * *